US005088367A

United States Patent [19]

Cracchiolo et al.

[11] Patent Number: 5,088,367

[45] Date of Patent: Feb. 18, 1992

[54] ROTARY DIE WITH ADJUSTABLE BLADE SEGMENT

[75] Inventors: Vincenzo Cracchiolo, Shelby Township, Macomb County; Terry L. Hawley, Howell; Robert E. Moore, Oxford; David D. Radlick; Frank S. Stuben, both of Sterling Heights, all of Mich.

[73] Assignee: Zerand-Bernal Group, Inc., Troy, Mich.

[21] Appl. No.: 559,057

[22] Filed: Jul. 30, 1990

[51] Int. Cl.[5] ..... B26D 1/62; B31B 1/14

[52] U.S. Cl. ..... 83/345; 83/343; 83/663; 83/700

[58] Field of Search ..... 83/698, 699, 700, 343, 83/345, 346, 663, 669, 670

[56] References Cited

U.S. PATENT DOCUMENTS

| | | | |
|---|---|---|---|
| 3,122,048 | 2/1964 | Warner | 83/700 X |
| 3,128,663 | 4/1964 | Dovey | 83/700 X |
| 3,354,768 | 11/1967 | Liick | 83/345 |
| 3,589,230 | 6/1971 | Neuman | 83/700 X |
| 3,752,042 | 8/1973 | Castille | 83/699 X |
| 4,020,724 | 5/1977 | Quinlan | 83/346 |
| 4,537,104 | 8/1985 | Dealto et al. | 83/700 X |
| 4,608,895 | 9/1986 | Bell et al. | 83/345 |
| 4,878,407 | 11/1989 | Harrison et al. | 83/698 X |

*Primary Examiner*—Mark Rosenbaum
*Assistant Examiner*—Eugenia A. Jones
*Attorney, Agent, or Firm*—Barnes, Kisselle, Raisch, Choate, Whittemore & Hulbert

[57] ABSTRACT

Rotary die cylinders for cutting blanks from thin sheets or webs of material. The die cylinders have coacting cutting blades, some of which are carried by die segments mounted on the die cylinders in axially and/or circumferentially adjusted positions.

3 Claims, 4 Drawing Sheets

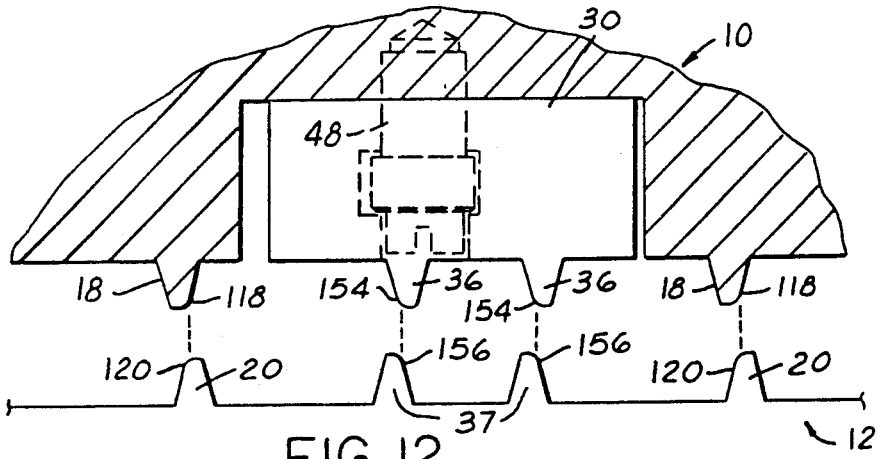
FIG. 12
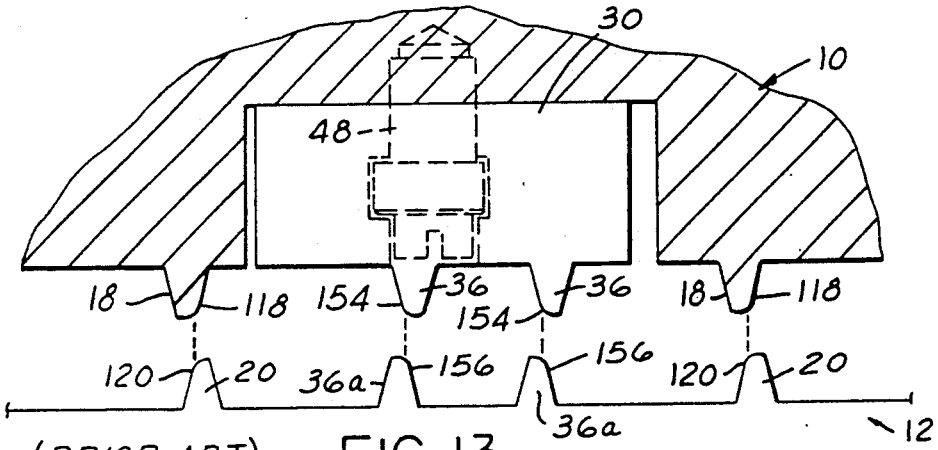
(PRIOR ART) FIG. 13
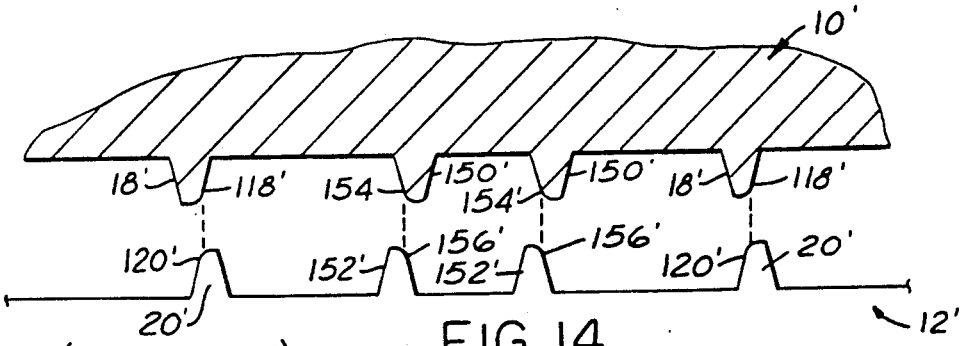
(PRIOR ART) FIG. 14
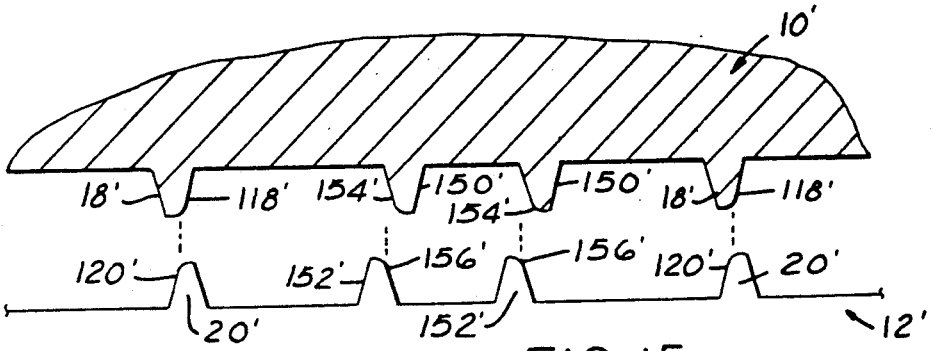
FIG. 15

ROTARY DIE WITH ADJUSTABLE BLADE SEGMENT

This invention relates generally to rotary die cutting of blanks from thin sheets or webs of material such as paper, paper board, cardboard, plastic film, metal foil, sheet metal and the like. More particularly, this invention relates to improved dies for rotary cutting having a pair of rotary die cylinders, and a blade-carrying die segment mounted on at least one of the die cylinders in axially and/or circumferentially adjusted position.

BACKGROUND

According to present practice as exemplified in U.S. Pat. No. 4,608,895, a web of material is cut along a predetermined line of severance by a pair of superimposed die cylinders having co-acting severing blades in the form of lands projecting generally radially outwardly from the main body of the cylinders. The lands have an outer face and a pair of spaced apart side faces. A cutting edge is defined by the outer face and one side face of each land. To enable adjustment of the lands on one die with respect to the lands on the other die into correct registration for co-acting to cut the web, the lands are constructed and arranged on the dies so that registration can be established by moving the die cylinders axially and/or in rotary phase relationship with respect to each other.

To permit this adjustment where the line of severance defines a closed figure or blank, the cutting action of the lands transfers from one edge to the other at least twice in two generally opposed pairs of cross-over sections in the co-acting lands. If, for example, the blank cut from a web is rectangular, and because of the transfer of the cutting action at the cross-over sections, the lands of each cylinder involved in cutting two axially spaced edges of the figure will be on the same side of the line of severance, and the lands of each cylinder involved in cutting the two circumferentially spaced edges of the figure will also be on the same side of the line of severance.

SUMMARY

Often a closed figure or blank is cut to provide tabs or openings or lines of perforations inside the boundary of the blank. In such cases, the lands on the die cylinders providing the co-acting cutting edges for making these inside cuts sometimes are constructed and arranged such that when the die cylinders are moved axially and/or in rotary phase relationship with respect to each other for correct registration of the lands which cut the line of severance defining the boundary of the blank, the lands having the edges performing the inside cuts actually move out of proper registration. In other words, the die cylinders might be moved axially and/or circumferentially relative to each other to bring closer together the lands having the co-acting edges for cutting the boundary line severance for the blank, but such relative movement of the die cylinders might at the same time move farther apart the lands having the cutting edges for making the inside cuts. The reasons for the non-conforming construction and arrangement of the lands having the cutting edges for the inside cuts may vary, but one reason is that the high speed stacking of blanks leaving the die cylinders requires that the slightly bent edges defining an inside cut must be inclined in a direction which facilitates the sliding of the blanks onto the stack without hang-ups or jamming.

Objects, features and advantages of this invention are to provide a pair of rotary die cylinders which can be readily and easily adjusted for proper registration or co-action of all of their cutting edges, including the edges for making cuts inside the boundary of a blank, have adjustable die segments on one or both of the die cylinders for carrying lands having at least some of the cutting edges, will decrease the tendency for cut blanks to hang up or snag when stacked, and to provide rotary die cylinders which can be economically manufactured and are rugged and durable.

BRIEF DESCRIPTION OF THE DRAWINGS

These and other objects, features and advantages of the invention will be apparent from the following detailed description, appended claims and accompanying drawings in which:

FIG. 12 is an enlarged semi-diagrammatic view showing the two die cylinders with a die segment mounted on one of the die cylinders, prior to adjustment of the cutting edges of the lands;

FIG. 13 is similar to FIG. 12 but after adjustment; and

FIGS. 14 and 15 are illustrative of the prior art, showing the positions of the lands before and after adjustment.

DETAILED DESCRIPTION

Figure 1:
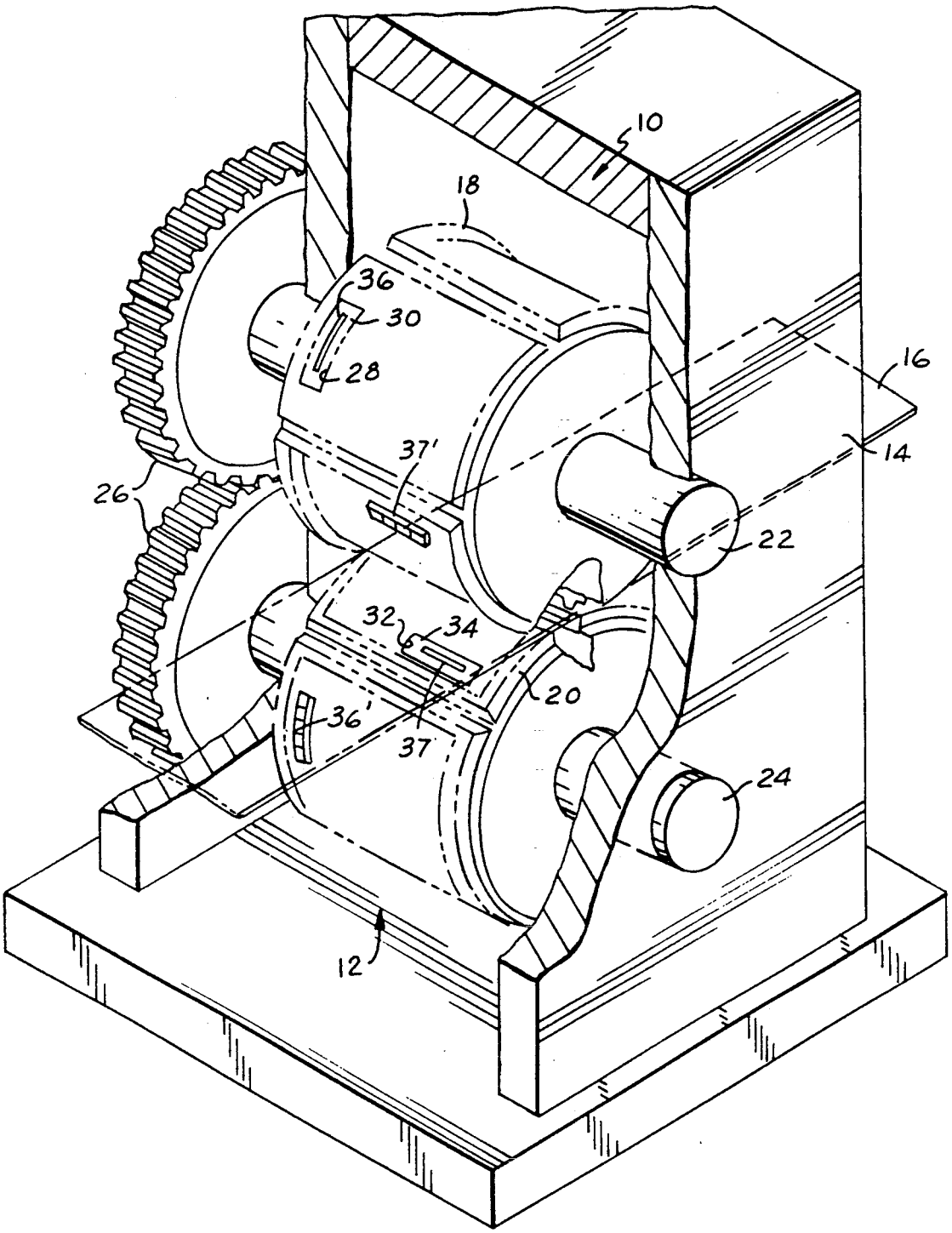
FIG. 1 is a perspective view of rotary dies having adjustable cutting segments, in accordance with the invention.

Referring now more particularly to the drawings, FIG. 1 is a perspective view illustrating a pair of rotary die cylinders 10 and 12 of this invention for cutting rectangular articles or blanks 14 from a web 16 of material passing between the dies. The material is cut by the edges of co-acting blades or lands 18 and 20 of the dies. Preferably the die cylinders are in the form of cylindrical bodies and have a plurality of pairs of co-acting lands on the cylindrical surface thereof which are equally spaced apart circumferentially. The die cylinders are journalled for rotation by shafts 22 and 24 which preferably are formed integrally with the dies. The dies are co-rotated in opposite directions of rotation at the same speed by a pair of meshed gears 26 each coupled to one of the shafts of the dies. Die cylinder 10 has a recess 28 in its cylindrical surface in which a die segment 30 is mounted. Die cylinder 12 has a recess 32 in its cylindrical surface in which a die segment 34 is mounted. The die segments have lands 36 and 37 provided with cutting edges for co-acting with similar cutting edges on lands 36' & 37' on the other die cylinder to form cuts within the outline of the blanks to provide lines of perforations or the like.

Figure 2:
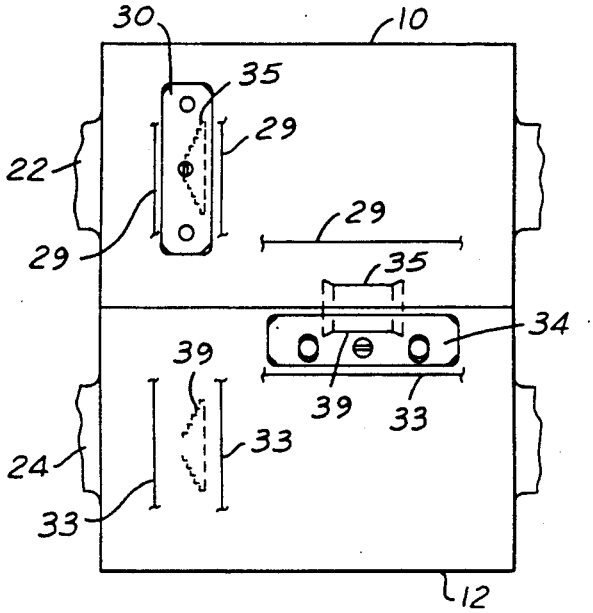
FIG. 2 is a semi-diagrammatic elevational view of the rotary dies, but for purposes of clarity, omitting the co-acting cutting lands, partially showing the lines of severance of closed figures or blanks to be cut from a web of material, showing die segments for making cuts within the boundaries of the blanks, and also showing the lines produced by the cutting edges of the lands on the die segments.
Figure 6:
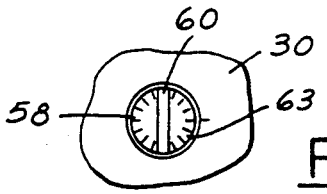
FIG. 6 is a fragmentary elevational view of a portion of FIG. 4.
Figure 4:
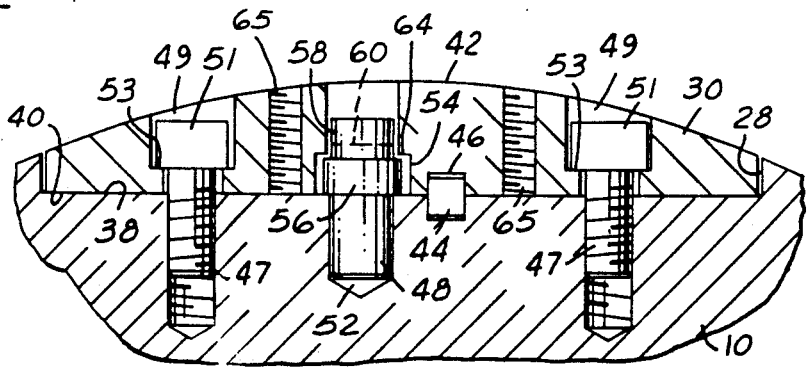
FIG. 4 is a sectional view taken on the line 4—4 in FIG. 3.
Figure 5:
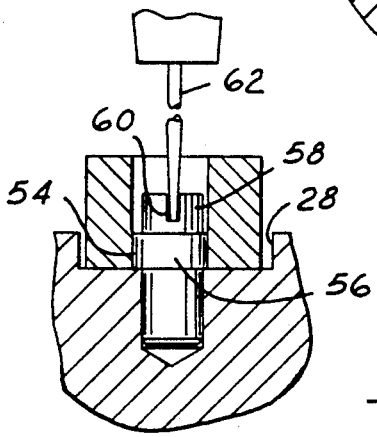
FIG. 5 is a sectional view taken on the line 5—5 in FIG. 3.
Figure 7:
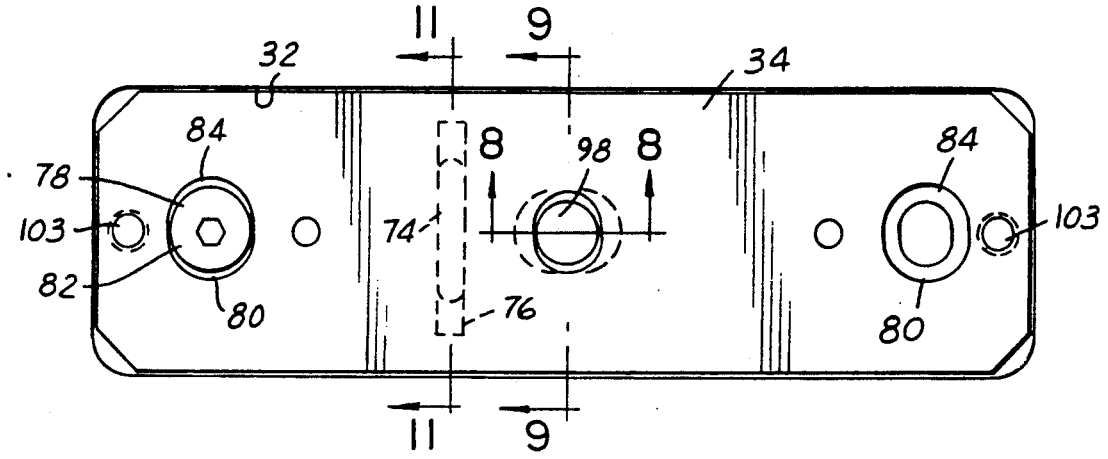
FIG. 7 is an enlargement of a portion of FIG. 2 showing the other die segment but omitting the cutting blades for clarity.
Figure 8:
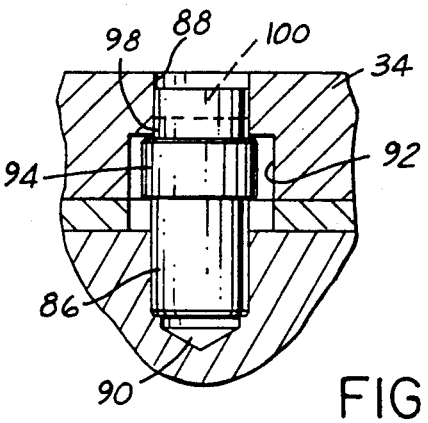
FIG. 8 is a fragmentary sectional view taken on the line 8—8 in FIG. 7.

FIG. 2 shows the die cylinders 10 and 12 but, for clarity, omits the cutting blades or lands. However, in FIG. 2 there is partially shown the lines of severance 29 and 33 of the omitted lands on the die cylinders for cutting blanks (of different outline than the blank which would be cut by the lands 18 and 20 in FIG. 1), and also the lines of severance 35 and 39 of the omitted lands on the die segments and on one of the die cylinders.

Figure 3:
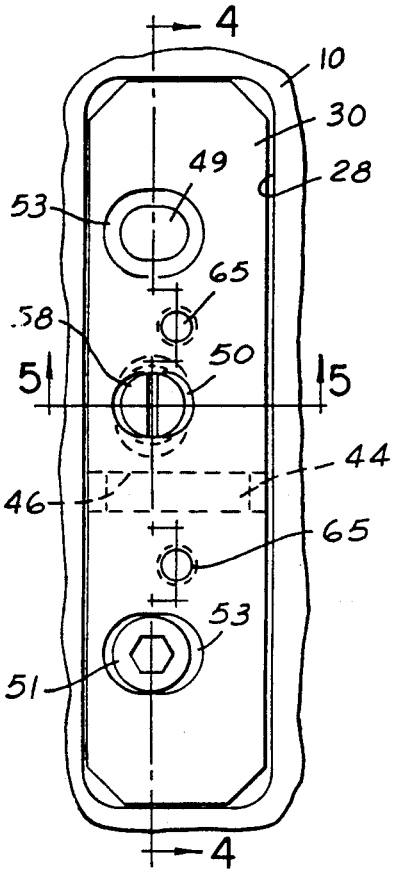
FIG. 3 is an enlargement of a portion of FIG. 2 showing one of the die segments but omitting the cutting blades for clarity.

The recess 28 for the die segment 30 is rectangular and elongated circumferentially, with a flat bottom surface 38 disposed in a plane parallel to the axis of rotation of the die cylinder. The die segment 30 is an elongated bar disposed lengthwise within the recess, having a flat bottom 40 slidably supported on the bottom surface 38 of the recess and a top surface 42 circumferentially curved to conform to the curvature of the die cylinder. The recess 28 is wider than the die segment 30 as seen in FIG. 3. To permit axial adjustment of the die segment, an elongated axially extending key 44 projects upwardly through the bottom of the recess 28 and is slidably received in an axially extending slot 46 across the bottom of the die segment. The key permits the die segment to be adjusted only in an axial direction.

The die segment 30 is releasably secured in adjusted position by bolts 47 extending through enlarged openings 49 in the die segment and threading into the die cylinder. The openings 49 are counterbored to received the bolt heads 51 which bear against the bottom 53 of the counterbores to clamp the die segment when the bolts are tightened.

When bolts 47 are loosened, die segment 30 may be shifted axially by a rotary adjustment member or stud 48 which extends through an opening 50 in the die segment and is rotatably received in a hole 52 in the bottom of the recess. The opening is enlarged to provide an oval-shaped portion 54 at the bottom, the circumferentially spaced sides of which are more closely spaced than the axially spaced sides. The stud 48 has a circular cam 56 disposed within the oval-shaped portion 54 and has a diameter equal to the minor diameter of the oval-shaped portion. The cam 56 is eccentric with respect to the rotational axis of the stud 48 so that when the stud is rotated, the cam 56 shifts the die segment 30 axially with respect to the die cylinder 10. The head 58 of the stud has a transverse slot 60 and may be rotated by a screw driver 62 or the like to axially adjust the die segment. The top of the enlarged oval-shaped portion 54 provides a shoulder 64 overlying the cam to prevent the stud from becoming separated from the die segment. Indicia 63 on the stud head and on the die cylinder mark the rotational position of the stud.

Tapped holes 65 in the die segment 30 are adapted to threadedly receive threaded lifting elements (not shown) to enable the die segment to be lifted from recess 28.

Figure 9:
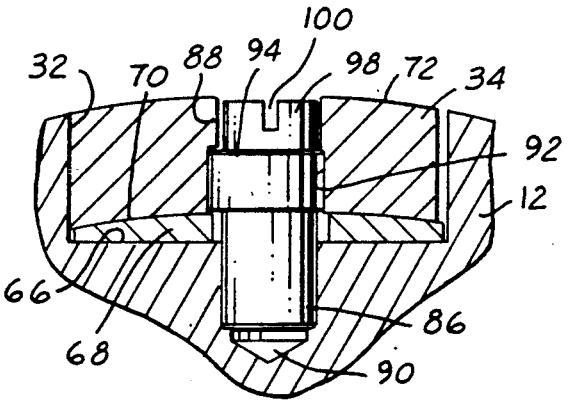
FIG. 9 is a fragmentary sectional view taken on the line 9—9 in FIG. 7.
Figure 10:
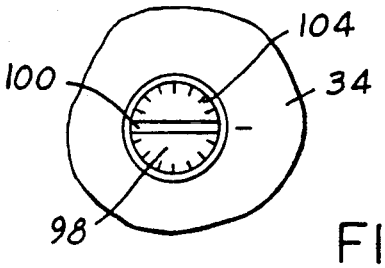
FIG. 10 is a view in elevation showing a portion in FIG. 8.
Figure 11:
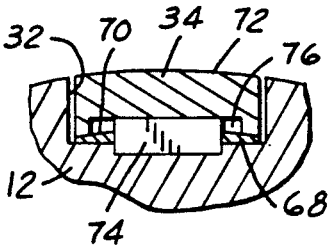
FIG. 11 is a sectional view taken on the line 11—11 in FIG. 7.

The recess 32 for the die segment 34 is rectangular and elongated axially and has a flat bottom surface 66 disposed in a plane parallel to the axis of rotation of the die cylinder. A plate or spacer 68 affixed by any suitable means to the bottom surface of the recess has a circumferentially extending top surface 70, the axis of which coincides with the axis of rotation of the die cylinder. The die segment 34 is an elongated bar disposed lengthwise within the recess 32 having a circumferentially extending bottom surface curved on the same radius as the top surface 70 of the spacer so as to have a flush surface-to-surface sliding engagement therewith. The top surface 72 of the die segment 34 is curved to conform with the cylindrical surface of the die cylinder 12. The recess 32 is wider than the die segment 34 as seen in FIG. 9. To permit circumferential adjustment of the die segment 34, an elongated circumferentially extending key 74 projects upwardly through the spacer 68 and is slidably received in a circumferentially extending slot 76 across the bottom of the die segment. The key 74 permits the die segment 34 to be adjusted only in a circumferential direction.

The die segment 34 is releasably secured in adjusted position by bolts 78 extending through enlarged openings 80 in the die segment and threading into the die cylinder. The openings 80 are counterbored to receive the bolt heads 82 which bear against the bottoms 84 of the counterbores to clamp the die segment when the bolts are tightened.

When bolts 78 are loosened, die segment 34 may be shifted circumferentially by a rotary adjustment member or stud 86 which extends through an opening 88 in the die segment 34 and is rotatably received in a hole 90 in the bottom of the recess. The opening 88 is enlarged to provide an oval-shaped portion 92 at the bottom, the axially spaced sides of which are more closely spaced than the circumferentially spaced sides. The stud 86 has a circular cam 94 disposed within the oval-shaped portion 92 and has a diameter equal to the minor diameter of the oval-shaped portion. The cam 94 is eccentric with respect to the rotational axis of the stud 86 so that when the stud is rotated, the cam 94 shifts the die segment 34 circumferentially with respect to the die cylinder 12. The head 98 of the stud has a transverse slot 100 and may be rotated by a screw driver or the like to circumferentially adjust the die segment 34. Indicia 104 on the stud head and on the die cylinder mark the rotational position of the stud.

The tapped holes 103 in the die segment 34 are adapted to threadedly receive threaded lifting elements (not shown) to enable the die segment to be lifted from the recess.

Referring now to FIGS. 14 and 15 which are illustrative of the prior art, die cylinders 10' and 12' are shown, which are like die cylinders 10 and 12 previously described except that neither has a die segment. The lands 18' and 20' on the cylindrical surface of the die cylinders 10' and 12' have cutting edges 118' and 120' which coact to cut a blank from a web of material passing between the rotating die cylinders. The die cylinders also have lands 150' and 152' on the cylindrical surface thereof with cutting edges 154' and 156' for making inside cuts within the margin of the blanks. However, it will be noted in FIGS. 14 and 15 that while the lands 18' on die cylinder 10' are left of the co-acting lands 20' on die cylinder 12', the lands 150' on die cylinder 10' are right of the co-acting lands 152' on die cylinder 12'. As previously stated, it may be necessary in the production of a particular blank, in order to ensure rapid and accurate stacking of blanks delivered at high speed from the die cylinders, that the relationship of the lands and cutting edges for making both the marginal line of severance for the blank as well as those for making inside cuts be constructed and arranged as shown in FIGS. 14 and 15. However, when the die cylinders 10' and 12' are shifted axially relative to each other to establish a proper registration of the cutting edges of lands 18' and 20', as for example, by moving die cylinders 10' rightward to bring the cutting edges 118' and 120' of lands 18 and 20 closer together, the cutting edges 154' and 156' of lands 150' and 152' are moved farther apart. This can be seen in FIGS. 14 and 15 in which FIG. 14 illustrates the relative positions of the lands and cutting edges before axial shifting of die cylinder 10' relative to die cylinder 12' and FIG. 15 illustrates the relative positions of the lands and cutting edges after axial shifting of die cylinder 10' relative to die cylinder 12'. Accordingly, in the prior art it was not always possible to adjust the relative positions of all of the cutting edges by a simple axial movement of one die cylinder relative to the other. Likewise, in prior art constructions, it was not always possible to adjust the relative positions of all of the cutting edges by a simple rotative or circumferential movement of one die cylinder relative to the other.

FIGS. 12 and 13 are illustrative of the present invention in which the lands 18 and 20 on the cylindrical surface of the die cylinders 10 and 12 have cutting edges 118 and 120 which coact to cut a blank from a web of material passing between the rotating die cylinders. However, the lands 36 having the cutting edges 154 which coact with cutting edges 156 of lands **36*a* on die cylinder 12 for making inside cuts within the margin of the blanks are on the adjustable die segment 30. Therefore, a relative axial shifting of the die cylinders 10 and 12 from the FIG. 12 position to the FIG. 13 position can be effected to properly register the lands 18 and 20 and cutting edges 118 and 120 on the cylindrical surface of the die cylinders, and the die segment 30 may be independently adjusted axially to properly register the lands 36 and 36*a* and cutting edges 154 and 156. Similarly, the die segment 34 on die cylinder 12 also makes it possible to circumferentially adjust the cutting blades of lands on the die segment independently of the other cutting blades or lands on die cylinder 12**.

While in the foregoing, there have been disclosed one blade-carrying die segment capable of axial adjustment only (segment 30) and one blade-carrying die segment capable of circumferential adjustment only, it should be understood that a compound die segment could be employed having a portion capable of axial adjustment and another portion capable of circumferential adjustment.

What is claimed is:

1. A pair of rotary die cylinders journalled for rotation in axially and circumferentially adjusted positions relative to one another and having first co-acting cutting blades fixed on the die cylinders and adapted to cut a web of material along a predetermined line of severance defining a closed figure and second co-acting cutting blades adapted to cut such web of material in an area within said line of severance, each of said die cylinders comprising a cylindrical body, a recess in one of said cylindrical bodies, a die segment receivable in said recess in said one cylindrical body, one of said second blades being carried by said die segment, means for guiding the adjustment of said die segment in said recess in at least one of the axially and circumferentially extending directions of said one cylindrical body, means supporting said die segment in said recess in said one cylindrical body in adjusted position with said one second cutting blade projecting radially outwardly, means for releasably securing said die segment in adjusted position in said recess, and means for shifting said die segment in said recess in said at least one of the axially and circumferentially extending direction when said securing means is released and preventing adjustment in any other directions.

2. The pair of rotary die cylinders defined in claim 1, wherein said shifting means includes a rotary adjustment member.

3. The pair of rotary die cylinders defined in claim 2, wherein said rotary adjustment member comprises a stud rotatably received in said one cylindrical body and having a cam engageable with said die segment.

* * * * *